US007475445B2

(12) United States Patent
Chai et al.

(10) Patent No.: US 7,475,445 B2
(45) Date of Patent: Jan. 13, 2009

(54) COUNTER-ROTATION WASH METHOD AND TRANSMISSION MACHINE

(75) Inventors: Yongsen Chai, Qingdao (CN); Zhancun Jiang, Qingdao (CN); Kaiming Wang, Qingdao (CN); Zhichun Zhang, Qingdao (CN); Peishi Lu, Qingdao (CN); Zezhen Hua, Qingdao (CN); Sheng Xu, Qingdao (CN); Zongrui Chi, Qingdao (CN)

(73) Assignees: Haier Group Corporation, Qingdao, Shangdong Province (CN); Haier Electric Appliances International Co., Ltd., Qingdao, Shangdong Province (CN)

( * ) Notice: Subject to any disclaimer, the term of this patent is extended or adjusted under 35 U.S.C. 154(b) by 405 days.

(21) Appl. No.: 10/492,786

(22) PCT Filed: Jun. 12, 2002

(86) PCT No.: PCT/CN02/00415

§ 371 (c)(1),
(2), (4) Date: Sep. 29, 2004

(87) PCT Pub. No.: WO03/033803

PCT Pub. Date: Apr. 24, 2003

(65) Prior Publication Data

US 2005/0039496 A1 Feb. 24, 2005

(30) Foreign Application Priority Data

Oct. 18, 2001 (CN) ..... 01 1 27557
Oct. 18, 2001 (CN) ..... 01 2 69651

(51) Int. Cl.
*D06F 37/40* (2006.01)

(52) U.S. Cl. ..... 8/159; 68/131; 68/133

(58) Field of Classification Search ..... 68/131, 68/133
See application file for complete search history.

(56) References Cited

U.S. PATENT DOCUMENTS

| | | | | | |
|---|---|---|---|---|---|
| 54,622 | A | * | 5/1866 | Stanles | 366/223 |
| 1,351,890 | A | * | 9/1920 | Cox et al. | 366/296 |
| 2,399,319 | A | * | 4/1946 | Bowen et al. | 475/318 |
| 2,538,620 | A | * | 1/1951 | Heinrich | 74/75 |
| 2,968,174 | A | * | 1/1961 | Bell et al. | 68/23.6 |

(Continued)

FOREIGN PATENT DOCUMENTS

| | | |
|---|---|---|
| CN | 2446143 | 9/2001 |

(Continued)

*Primary Examiner*—Frankie L Stinson
(74) *Attorney, Agent, or Firm*—Kenyon & Kenyon LLP

(57) ABSTRACT

A transmission mechanism suitable to be used in a washing machine for creating dual-direction driving comprises a drive power input end and two drive power output ends, in which one of drive power output ends is connected to an agitator shaft (10) to drive the agitator shaft rotating in a first direction; while the other of drive power output ends is connected with an inner basket shaft (11) to drive the inner basket shaft rotating in a second direction opposed to the first direction. A washing machine for creating dual-direction washing and a washing method for creating dual-direction washing in a washing machine are disclosed in the present invention. Furthermore, an agitator and an inner basket suitable to be used in the washing machine are disclosed in the present invention.

20 Claims, 7 Drawing Sheets

U.S. PATENT DOCUMENTS

| | | | | | |
|---|---|---|---|---|---|
| 3,058,329 | A | * | 10/1962 | Searle | 68/23.6 |
| 3,306,133 | A | * | 2/1967 | Rhein et al. | 475/149 |
| 4,848,105 | A | * | 7/1989 | O'Connell et al. | 68/18 F |
| 4,868,944 | A | * | 9/1989 | Ishino et al. | 8/158 |
| 4,910,979 | A | * | 3/1990 | Burk et al. | 68/23.7 |
| 5,000,016 | A | * | 3/1991 | Burk et al. | 68/23.7 |
| 5,187,954 | A | * | 2/1993 | Kim et al. | 68/3 R |
| 5,231,857 | A | * | 8/1993 | Rew et al. | 68/134 |
| 5,473,916 | A | * | 12/1995 | Ye | 68/134 |
| 6,286,344 | B1 | * | 9/2001 | Jeon et al. | 68/23.1 |
| 7,197,783 | B2 | * | 4/2007 | Wilson et al. | 8/159 |

FOREIGN PATENT DOCUMENTS

| | | | |
|---|---|---|---|
| CN | 2458326 | | 11/2001 |
| CN | 2458327 | | 11/2001 |
| CN | 2467550 | | 12/2001 |
| JP | 59-171588 | | 9/1984 |
| JP | 59-214488 | * | 12/1984 |
| JP | 62-87316 | * | 4/1987 |
| JP | 3-057488 | | 3/1991 |
| JP | 3-68397 | * | 3/1991 |
| JP | 3-683397 | * | 3/1991 |
| JP | 5-087352 | | 4/1993 |
| JP | 53-25072 | | 12/1993 |
| JP | 10-127972 | * | 5/1998 |
| JP | 2000-42286 | * | 2/2000 |
| JP | 2000-134869 | * | 5/2000 |
| JP | 2001-162087 | * | 6/2001 |
| KR | 2001079351 | * | 8/2001 |
| WO | WO 95/03502 | | 2/1995 |

* cited by examiner

COUNTER-ROTATION WASH METHOD AND TRANSMISSION MACHINE

TECHNICAL FIELD

The present invention relates generally to a transmission mechanism suitable to be used in a washing machine, particularly to a transmission mechanism for creating dual-direction rotation. The present invention relates also to a washing machine for creating dual-direction washing. Furthermore, the present invention relates to a washing method in a washing machine, which method can realize dual-directional washing. The present invention relates to an agitator and an inner basket for using in the washing machine.

BACKGROUND OF THE INVENTION

It is well known that washing machines are widely used in domestic and the industrial application. According to the arrangement of the inner basket in a washing machine, conventional washing machines can be divided into two types: the vertical type and the horizontal type. Generally, a vertical type of a washing machine includes an inner basket, an outer basket, a agitator, a driving system and a control system. In the vertical type of a washing machine, an inner basket is disposed vertically in the outer basket, and an agitator is installed on an agitator shaft and is disposed on the bottom of the inner basket. The driving system has an output end and an input end. The agitator shaft is connected to the output end of the driving system. During washing, generally the inner basket does not rotate, while the agitator rotates in two opposite directions alternately. The agitator agitates the water inside the inner basket to rotate and realize washing. However, it has been found that there are a few defects in such a type of the existing washing machine. During washing, the impact strength of the water produced by the agitator is relatively weak, cloths are prone to be tangled and it is quite difficult to increase the ratio of washing to cleanness. In order to overcome the above-mentioned defects, a design of a washing machine with a rotating basket has been developed in the washer's manufacturer, wherein the inner basket is not fixed and is kept in the form of a free float. When the agitator rotates, the inner basket creates a counter-action against the impacting force of the water caused by the rotation of the agitator, so as to make the inner basket to rotate in a opposite direction likely to achieve the "rubbing" effect. However, the rubbing effect obtained by such a arrangement is still not satisfactory. Because a driving power is not imparted to the inner basket, the rotation capability of the inner basket is quite little, and the agitator only rotates on the bottom of the inner basket alternately. Thus, the "rubbing" effect obtained by this washing method is not substantially improved, and the problem of tangling cloths can not be solved well. In a horizontal type of a washing machine, two rolling cylinders which rotate in opposite directions are disposed horizontally. They are connected to two driving power sources and rotate in the opposite directions. Although such a type of a washing machine can realize a better "rubbing" effect, its structure is quite complicated and its cost is higher in manufacture. In order to overcome the defects in the existing washing machine, the present invention provides a transmission mechanism for creating dual-directional rotation suitable to be used in a washing machine. Particularly, this transmission mechanism is suitable for a washing machine in a vertical type.

SUMMARY OF THE INVENTION

It is an object of the present invention to provide a transmission mechanism for creating dual-directional rotation, in which the transmission mechanism is suitable to be used in a washing machine in a vertical type and can create rotations in the opposite directions at its two output ends.

It is another object of the present invention to provide a washing machine for creating dual-directional washing, in which the washing machine makes both the inner basket and the agitator to rotate in the opposite directions to each other under the driving action of a driving power during washing.

It is still another object of the present invention to provide a washing machine for creating dual-directional washing, in which the washing machine has compact structure, smaller volume, higher reliability, and better washing or rubbing effect.

It is yet another object of the present invention to provide a washing method for creating dual-directional washing, in which the method can realize rotations of the inner basket and the agitator in two opposite directions to increase the strength of the water stream and improve the ratio of washing to cleanness.

It is a further object of the present invention to provide an agitator and an inner basket for a washing machine. These parts can increase the strength of the water stream and promote the flow rate of the water within the inner basket.

In order to achieve above objects, the present invention provides a transmission mechanism suitable to be used in a washing machine for creating dual-directional driving, in which the transmission mechanism has a drive power input end. Further, it includes two drive power output ends, wherein one of the drive power output ends is connected to an agitator shaft to make the agitator shaft to rotate in a first direction; while the other of drive power output ends is connected to an inner basket shaft to drive the inner basket shaft rotate in a second direction opposed to the first direction.

The present invention also provides a washing machine for creating dual-directional washing, in which the washing machine comprises an outer basket, an inner basket disposed within the outer basket, an agitator disposed on the bottom of the inner basket, an inner basket shaft and an agitator shaft. The washing machine further comprises a transmission mechanism for creating dual-directional driving, in which the transmission mechanism has a drive power input end which is connected to a drive power source, and two drive power output ends, wherein one of the drive power output ends is connected to one end of the agitator shaft in the washing machine to make the agitator shaft to rotate in a first direction, the other end of the agitator shaft is provided with the agitator; the other of drive power output ends is connected to one end of the inner basket shaft to make the inner basket shaft to rotate in a second direction opposed to the first direction; the other end of the inner basket shaft is installed on the inner basket.

The present invention further provides a washing method for creating dual-directional washing in a washing machine, the step of the method includes: providing a transmission mechanism having two drive power output ends, connecting an agitator shaft and an hollow inner basket shaft to the two drive power output ends, respectively; rotatably disposing the agitator shaft inside the hollow inner basket shaft; driving the inner basket shaft rotating in a first direction; and driving the agitator shaft rotating in a second direction opposed to the first direction.

In summary, by using a transmission mechanism for creating dual-directional rotation, a washing machine and a method for creating dual-directional washing and an inner basket and a agitator associated with the washing machine in accordance with the present invention, the following advantages are achieved: a transmission mechanism for creating dual-directional rotation is provided, in which the transmission mechanism realizes that the inner basket and the agitator rotate in two opposite directions with respect to each other. The strength of the water stream in the washing machine is enhanced during washing and the ratio of washing to cleanness is improved. At the same time when the inner basket and the agitator rotate in two opposite directions with respect to each other, the respective rotating directions of the inner basket and the agitator can be changed intermittently and alternatively to make the impact direction of the water stream is in frequent changes. Thus, cloths are easier to be rolled and its tangle decreases. The transmission mechanism and the washing machine in accordance with the present invention have compact structure, smaller volume, higher reliability, and longer service time. The structures of the inner basket and the agitator promote enhancing the water to be agitated and increasing the impact force of the water stream.

BRIEF DESCRIPTION OF THE DRAWINGS

The objects, features and advantages of the present invention can further be understood by the following detailed description, taken in connection with the accompanying drawings, in which.

DETAILED DESCRIPTION OF THE PREFERRED EMBODIMENTS

Figure 1:
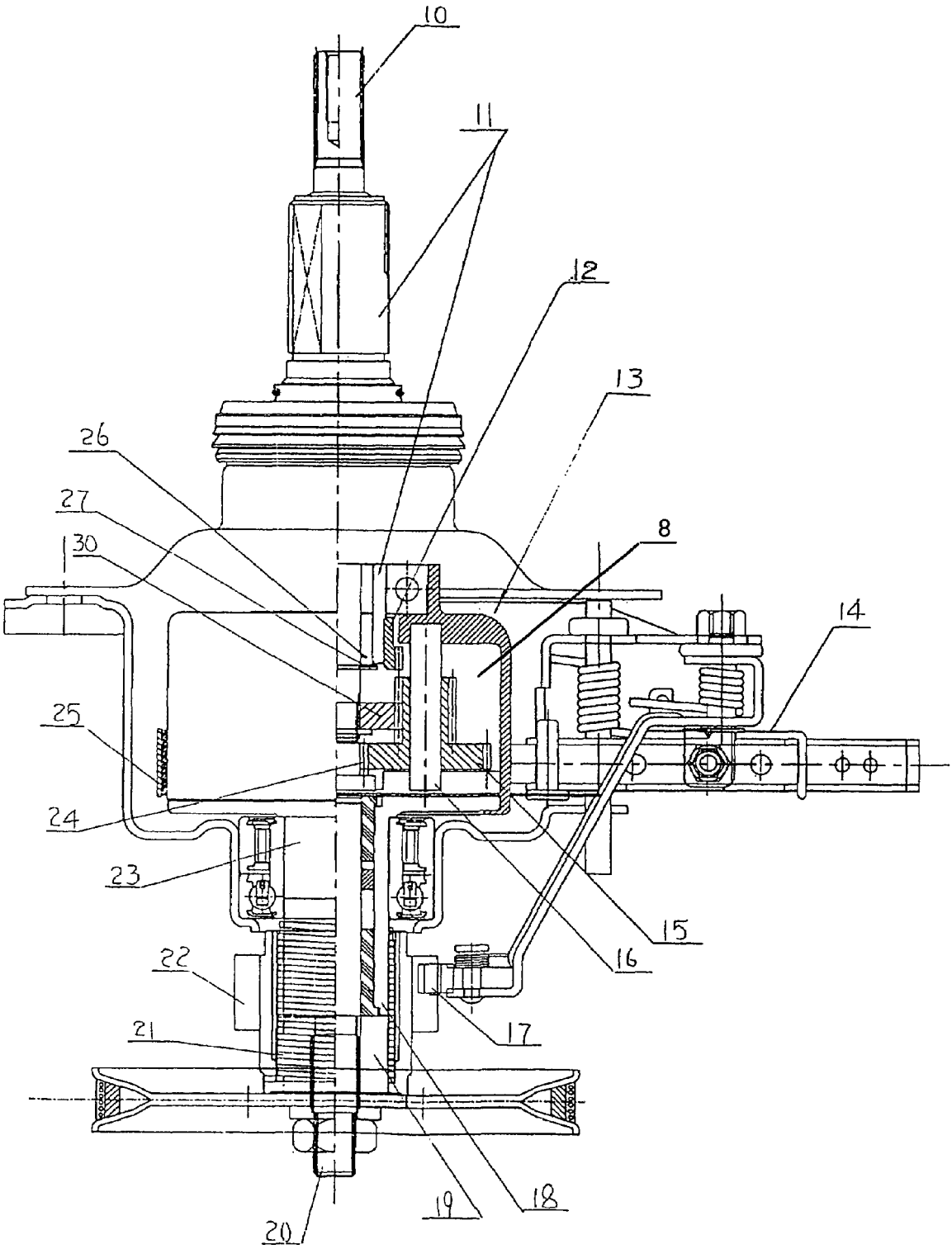
FIG. 1 is a semi-sectional view of a transmission mechanism for creating dual-directional rotation suitable to be used in a washing machine in accordance with an embodiment of the present invention.
Figure 2:
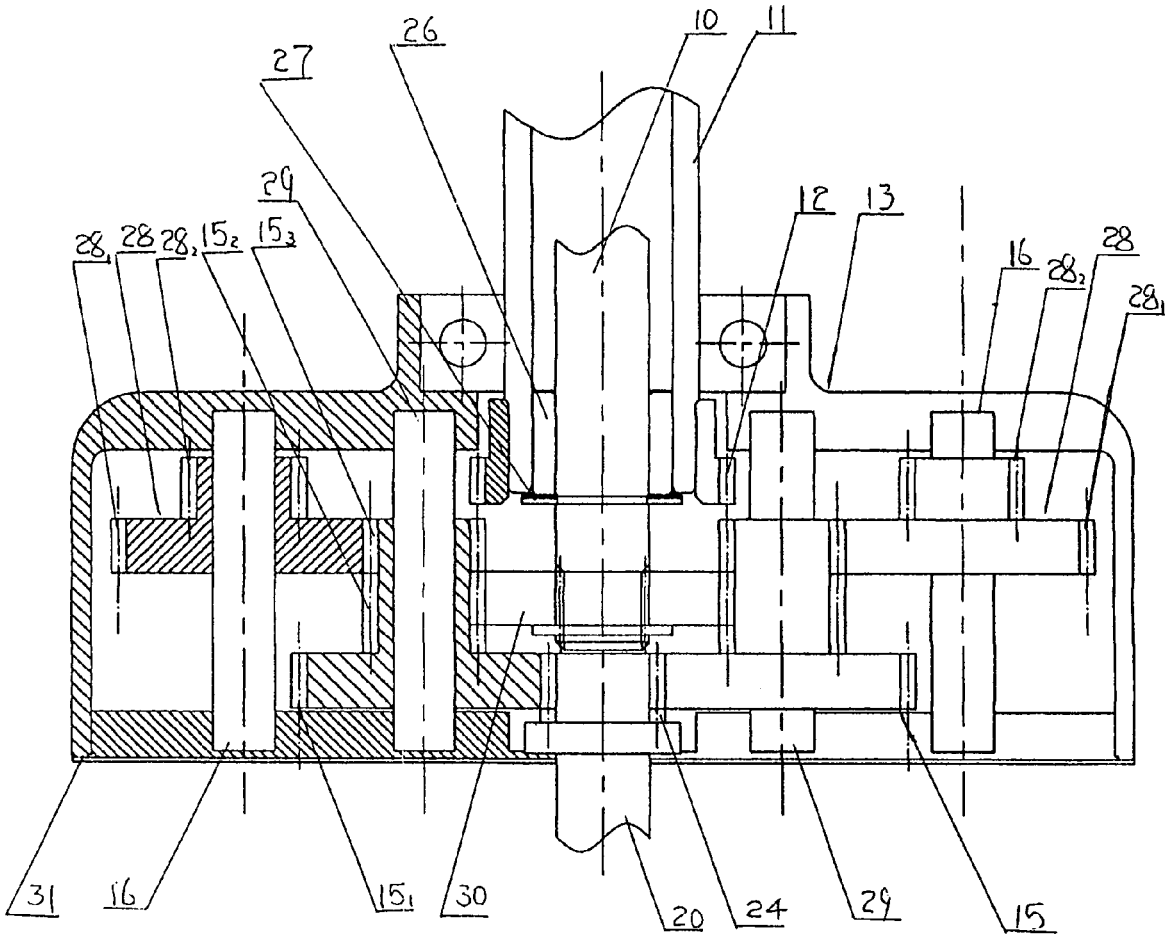
FIG. 2 is a semi-sectional view of a gearbox used for the transmission mechanism shown in FIG. 1.
Figure 3:
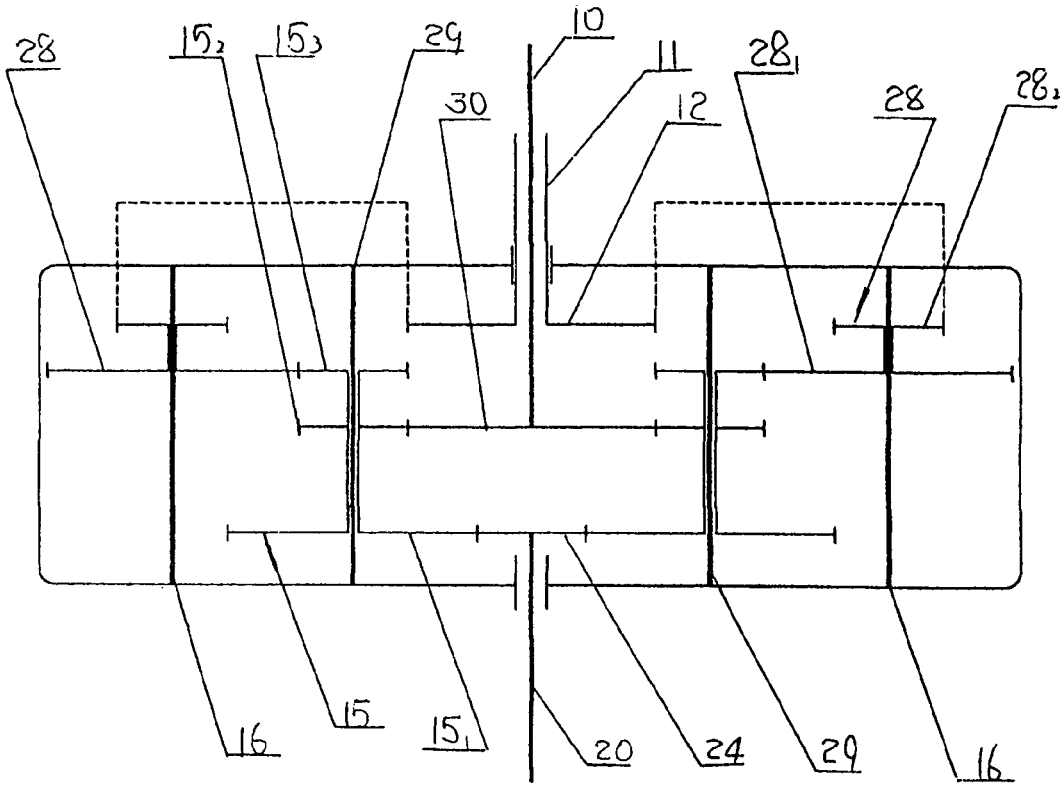
FIG. 3 is a schematic view of the transmission system having the transmission mechanism in accordance with the present invention shown in FIG. 1.
Figure 4:
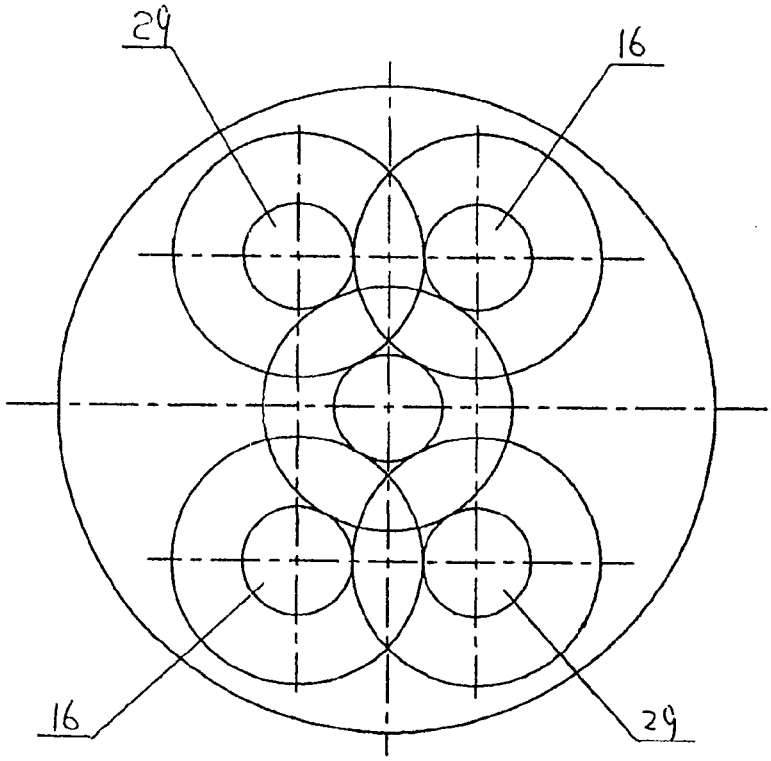
FIG. 4 is a schematic plan view of the transmission members of the transmission mechanism arranged within the gearbox shown in FIG. 2.
Figure 5:
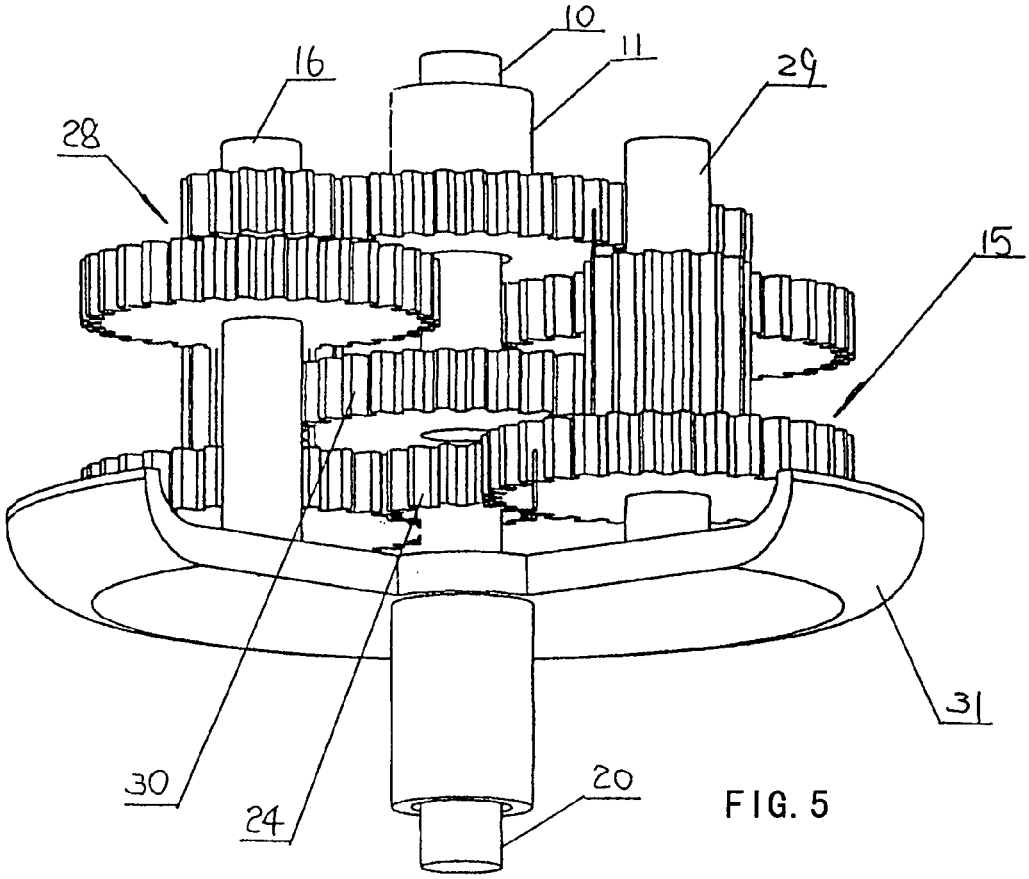
FIGS. 5 and 6 are perspective views of the transmission members of the transmission mechanism in different orientations located in the gearbox shown in FIG. 2.
Figure 6:
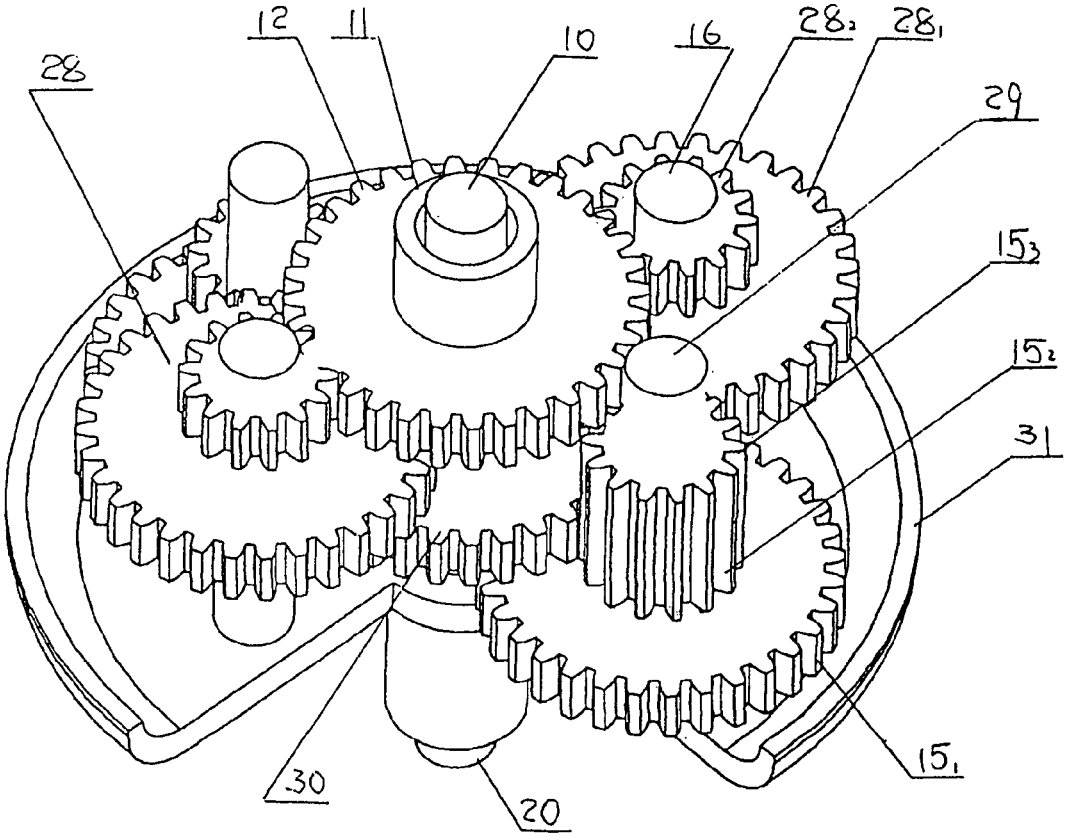

FIG. 1 shows a transmission mechanism 8 for creating dual-directional rotation suitable to be used in a washing machine in accordance with an embodiment of the present invention. The transmission mechanism includes a substantially cylinder-shaped gearbox 13. The gearbox 13 is longitudinally provided with shaft holes in the upper and lower end walls thereof in a longitudinal direction, respectively. A hollow inner basket shaft 11 extends through the shaft hole arranged in the upper end wall of the gearbox 13 and is rotatably disposed in the gearbox. The lower end of the hollow inner basket shaft 11 extends downwards through the upper end wall into the gearbox 13. An agitator shaft 10 is concentrically disposed inside the hollow inner basket shaft 11 and can rotate therein. A main drive shaft 20 extends through the shaft hole arranged in the lower end wall of the gearbox 13 and can rotate in the gearbox. The upper end of the main drive shaft 20 is disposed inside the gearbox 13, and the lower end thereof extends downwards and outwards through the lower end wall of the gearbox 13. Referring to FIGS. 2-6, two pairs of gear axles 16, 29 are symmetrically disposed in the radial direction with respect to the longitudinal axis of the gearbox 13, respectively. Each of pairs of the gear axles 16, 29 is rotatably disposed in axle holes arranged in the upper and lower end wall of the gearbox 13, respectively. As shown in FIGS. 3, 5 and 6, each of the pair of gear axles 16 is provided with a gear part 28 in an inverted cross section, which consists of two integrally formed gears $\mathbf{28}_1$, $\mathbf{28}_2$ with different diameters, and each of the pair of gear axles 29 is provided with a gear part 15 thereon, which includes three integrally formed gears $\mathbf{15}_1$, $\mathbf{15}_2$, $\mathbf{15}_3$ with different diameters. Alternatively, these three gears can also have same diameter. In this case, each of a pair of gear parts 15 has three gears $\mathbf{15}_1$, $\mathbf{15}_2$, and $\mathbf{15}_3$, while each of a pair of gear parts 28 has two gears $\mathbf{28}_1$, and $\mathbf{28}_2$. In another embodiment of the invention, the pairs of the gear parts 28 and 15 can be directly formed on the pairs of the corresponding gear axles 16 and 29, respectively (not shown). When the agitator shaft 10 is inserted into the inside of the hollow inner basket shaft 11, a gap remains between the agitator and the inner wall of the inner basket shaft so that the agitator and the inner basket shaft do not interfere with each other and can be rotated separately. The lower end of the agitator shaft 10 extends beyond the lower end of the inner basket shaft 11 and a gear 30 is disposed thereon. The gear 30 meshes with the second gear $\mathbf{15}_2$ of each of the pair of gear parts 15 respectively. The lower end of the inner basket shaft 11 is also provided with a gear 12, which meshes with the second gear $\mathbf{28}_2$ of each of the pair of gear parts 28 respectively. When the gears 30 and 12 mesh with the second gears $\mathbf{15}_2$ and $\mathbf{28}_2$, respectively, the third gear $\mathbf{15}_3$ of each of the pair of gear parts 15 meshes with the first gear $\mathbf{28}_1$, of each of the pair of gear parts 28 correspondingly. In an embodiment of the present invention, the second and third gears $\mathbf{15}_2$ and $\mathbf{15}_3$ of each of the pair of gear parts 15 can be formed as a gear having a thickness equal to or larger than the sum of thickness of gears 30 and $\mathbf{28}_1$. Therefore, they can mesh with the gear 30 and the gear $\mathbf{28}_1$, simultaneously and respectively. A gear 24 is installed at the upper end of the main drive shaft 20 disposed inside the gearbox 13. The gear 24 meshes with the first gear $\mathbf{15}_1$, of each of the pair of gear parts 15, respectively. The lower end of the main drive shaft 20 can be connected to a drive power source, which can be a drive power input end.

The dual-directional rotation according to the present invention is achieved by means of the above-described transmission mechanism 8. Referring FIGS.3 and 7, when a drive power source such as an electrical motor 9 inputs a drive power via a pulley 7 disposed at the lower end of the main drive shaft 20, the motor 9 drives the main drive shaft 20 to rotate for example in a clockwise direction, thus the gear 24 is also rotated in a clockwise direction. The rotation of the gear 24 causes each of the pair of gear parts 15 to rotate in a counter-clockwise direction by means of the corresponding gears $\mathbf{15}_1$ thereon respectively. Furthermore, the gear 30 rotates in a clockwise direction via the corresponding gear $15_2$ of each of the pair of gear parts 15, so as to cause the agitator shaft 10 to rotate in a clockwise direction. At the same time when the agitator rotates in the clockwise direction, with the rotation of the corresponding gears $15_3$ of the pair of gear parts 15 in a counter-clockwise direction, which meshes with the corresponding first gears $28_1$, of the pair of gear parts 28, the gear parts 28 rotate in a reverse direction thereto, i.e. in a clockwise direction. Then, the gear 12 rotates in a counter-clockwise direction via the corresponding gear $28_2$ of the pair of the gear parts 28, so as to cause the inner basket shaft 11 to rotate in a counter-clockwise direction. Thus, it can be achieved that the agitator shaft 10 and the inner basket shaft 11 rotate in opposite directions to each other. Naturally, the agitator shaft and the inner basket shaft can also rotate to each other in reverse directions opposed to above-described rotating directions, which depends on a rotating direction selected when the drive power source is inputted. Similarly, if the drive power from the drive power source drives the main drive shaft 20 to rotate in a counter-clockwise direction, finally a rotation of the agitator shaft 10 in a counter-clockwise direction is achieved, and the inner basket shaft 11 rotates in a clockwise direction.

Figure 7:
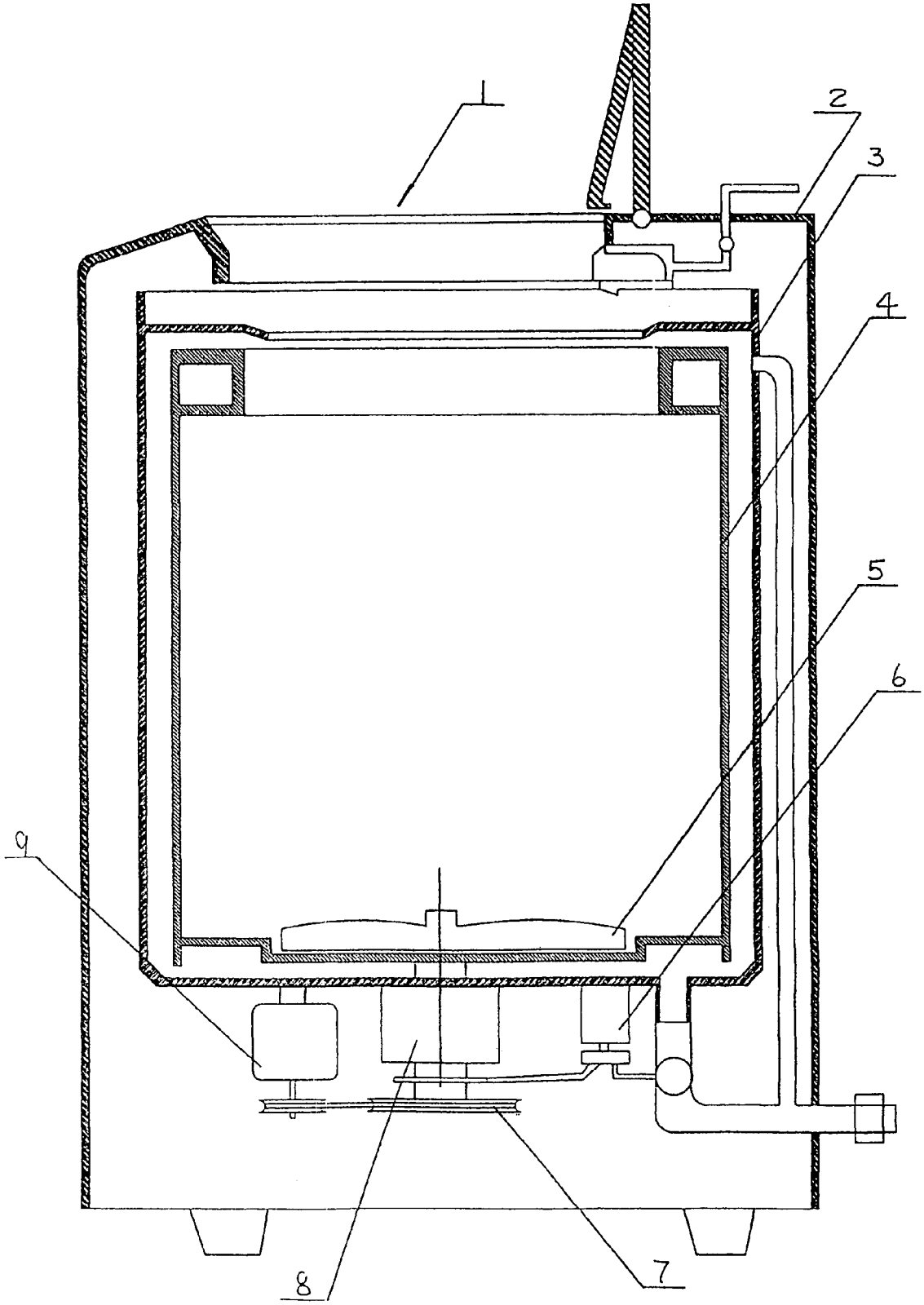
FIG. 7 is a schematic view of an embodiment of a washing machine for creating dual-directional washing, including a transmission mechanism for creating dual-directional rotation.

Referring to FIG. 7, an embodiment of a washing machine for a dual-direction washing including a transmission mechanism 8 for creating dual-directional rotation in accordance with the present invention is shown. The washing machine, which is generally shown by a reference number 1, includes an outer basket 3, an inner basket 4, an agitator 5, and a transmission mechanism 8 as described above. In the washing machine, both the outer basket and the inner basket are barrel-shaped, and the inner basket is located inside the outer basket. The upper end of the inner basket shaft 11 is fixedly installed on a bottom wall of the inner basket 4, and the upper end of the agitator shaft 10 disposed inside the hollow inner basket shaft 11 extends beyond the upper end of the inner basket shaft and is fixedly installed on the agitator 5. This arrangement realizes that the inner basket 4 and the agitator 5 can rotate in two opposite directions with respect to each other when the inner basket shaft 11 rotates in an opposite direction opposed to the direction in which the agitator shaft 10 rotates. A pulley 7 is installed at the lower end of the main drive shaft 20, and can be connected to a pulley which is arranged in a drive power source, such as an electrical motor 9. Thus, the electrical motor can drive the main drive shaft to rotate. In the transmission mechanism of the washing machine in accordance with the present invention, the inner basket shaft 11, the agitator shaft 10 and the main drive shaft 20 locate at the same axis.

In a washing machine incorporating a transmission mechanism for creating dual-direction rotation in accordance with the present invention, the dual-direction washing is achieved by means of the transmission mechanism. In order to achieve that the inner basket 4 and the agitator 5 rotate in two opposite directions with respect to each other during washing, the transmission mechanism of the invention is provided with two drive power output ends in addition to a drive power input end, wherein one of the drive power output ends is connected to a agitator 5 to cause it to rotate in a first direction, for example in the clockwise direction; while the other of the drive power output ends is connected to an inner basket 4 to cause it to rotate in a second direction opposed to the first direction, for example in a counter-clockwise direction. Thus, the transmission mechanism of the invention has two drive power output ends to create driving rotations in two opposite directions. Hereinafter, operation of the washing machine of the invention is described in more details.

During washing, the electrical motor 9 drives the main drive shaft 20 and causes it to rotate in a first direction via the pulley 7. The gear 24 of the main drive shaft 20 makes the first gears $15_1$, of the pair of gear parts 15 which mesh with the gear 24, respectively, to rotate in a second direction, so that the second gears $15_2$ of the pair of gear parts 15 drive the gear 30 which mesh with them respectively to rotate in the first direction. Thus, the agitator shaft 10 follows rotation of the gear 30 and causes the agitator 5 to rotate in the first direction. At the same time, the third gears $15_3$ of the pair of gear parts 15 drive the first gears $28_1$, of the pair of gear parts 28 which mesh with the gear 24, respectively, to rotate in the first direction, so that the second gears $28_2$ of the pair of gear parts 28 drive the gear 12 which meshes with them respectively to rotate in the second direction. Consequently, the inner basket shaft 11 follows rotation of the gear 12 and causes the inner basket 4 to rotate in the second direction.

A dual-directional washing method in accordance with the present invention can be realized by the washing machine for a dual-direction washing in a such manner that an agitator shaft and an inner basket shaft are connected to output ends of a transmission mechanism, respectively, and an input end of the transmission mechanism is coupled to a drive power source, for example an electrical motor 9. When the agitator shaft rotates in a direction, the inner basket shaft is driven to rotate in another direction opposed to the rotation direction of the agitator shaft. In an alternative embodiment of the present invention, the transmission mechanism can be provided with two output ends and two input ends, each of the input ends is coupled to the respective one of two different drive power sources, and two output ends are respectively connected to an agitator shaft and an inner basket shaft. Thus, a drive power source drives the agitator shaft, and another drive power source drives the inner basket shaft.

Figure 8:
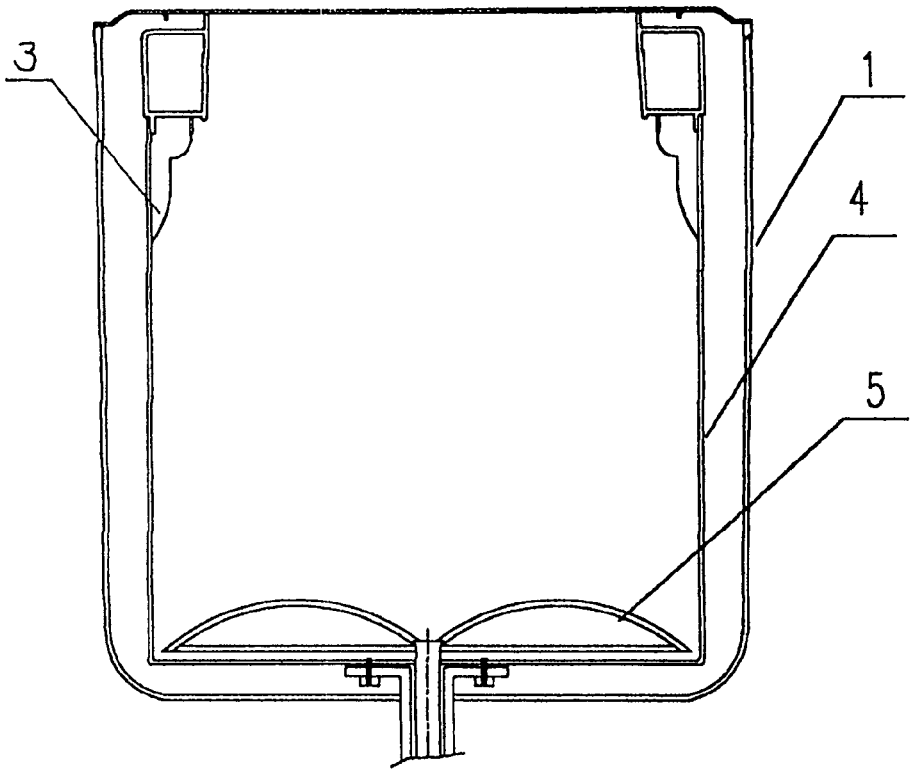
FIG. 8 shows an agitator and an inner basket in accordance with an embodiment of the present invention.

Referring to FIG. 8, an embodiment of an agitator 5 in accordance with the present invention is shown, wherein the agitator is a disk-shaped member, and an upward or convex protrusion is formed on the upper surface of the disk-shaped member to make the agitator to disturb the water stream in an inner basket and to further promote the agitation of the water. In a non-illustrated embodiment, at least one inward protrusion in the radial direction can also be formed on the sidewall of the inner basket.

Figure 9:
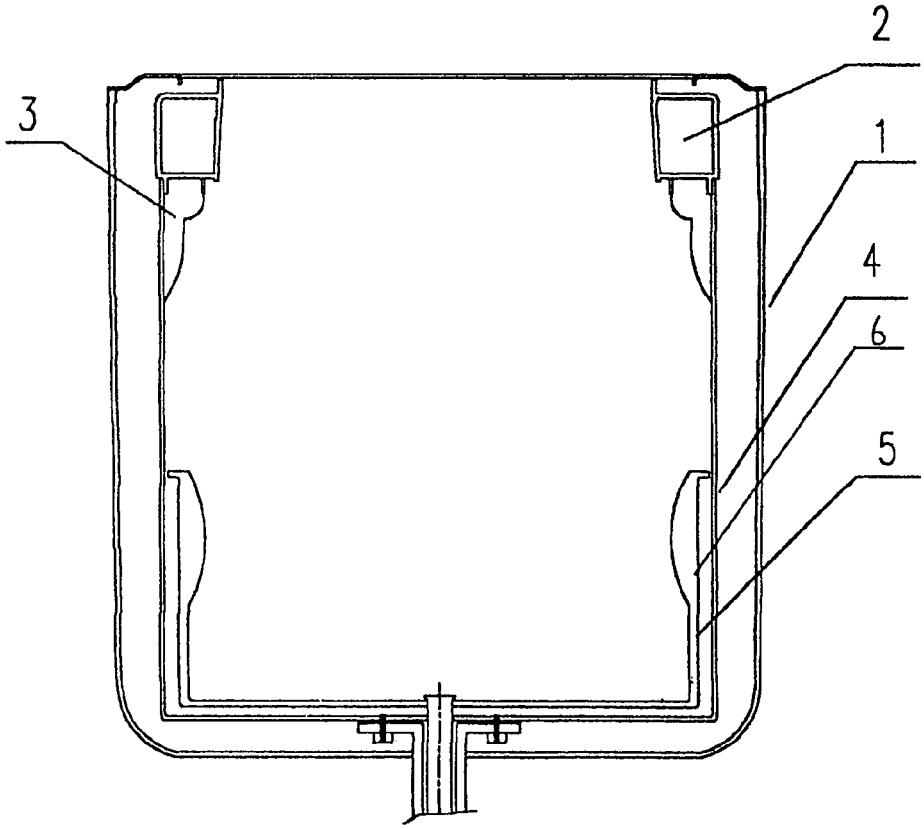
FIG. 9 shows an agitator and an inner basket in accordance with another embodiment of the present invention.

Referring to FIG. 9, another embodiment of an agitator 5 in accordance with the present invention is shown, wherein the agitator is a barrel-shaped member and its inner bottom surface is a plane. But, an upward or convex protrusion (not shown) is also formed on this bottom surface. Further as shown, an inward protrusion in the radial direction is provided on the inner sidewall of the agitator so as to increase the water area covered by the agitator and to raise the flow rate of the water. Alternatively, the inner sidewall can also be a smooth surface, Referring to FIG. 10, still another embodiment of an agitator 5 in accordance with the present invention is shown, wherein the agitator is a barrel-shaped member and its inner bottom surface is formed with a circular upward protrusion, while an inward protrusions in the radial direction are further formed on the inner sidewall of the agitator, so as to further increase the water area contacted by the agitator. These protrusions can be different and irregular in shape and are arranged in the circumference continuously or intermittently. The arrangements of protrusions promote profitably increase the impact strength of the water stream to the washed clothes, make the cloths to roll more easily and decrease tangling in the washing machine during washing.

Figure 10:
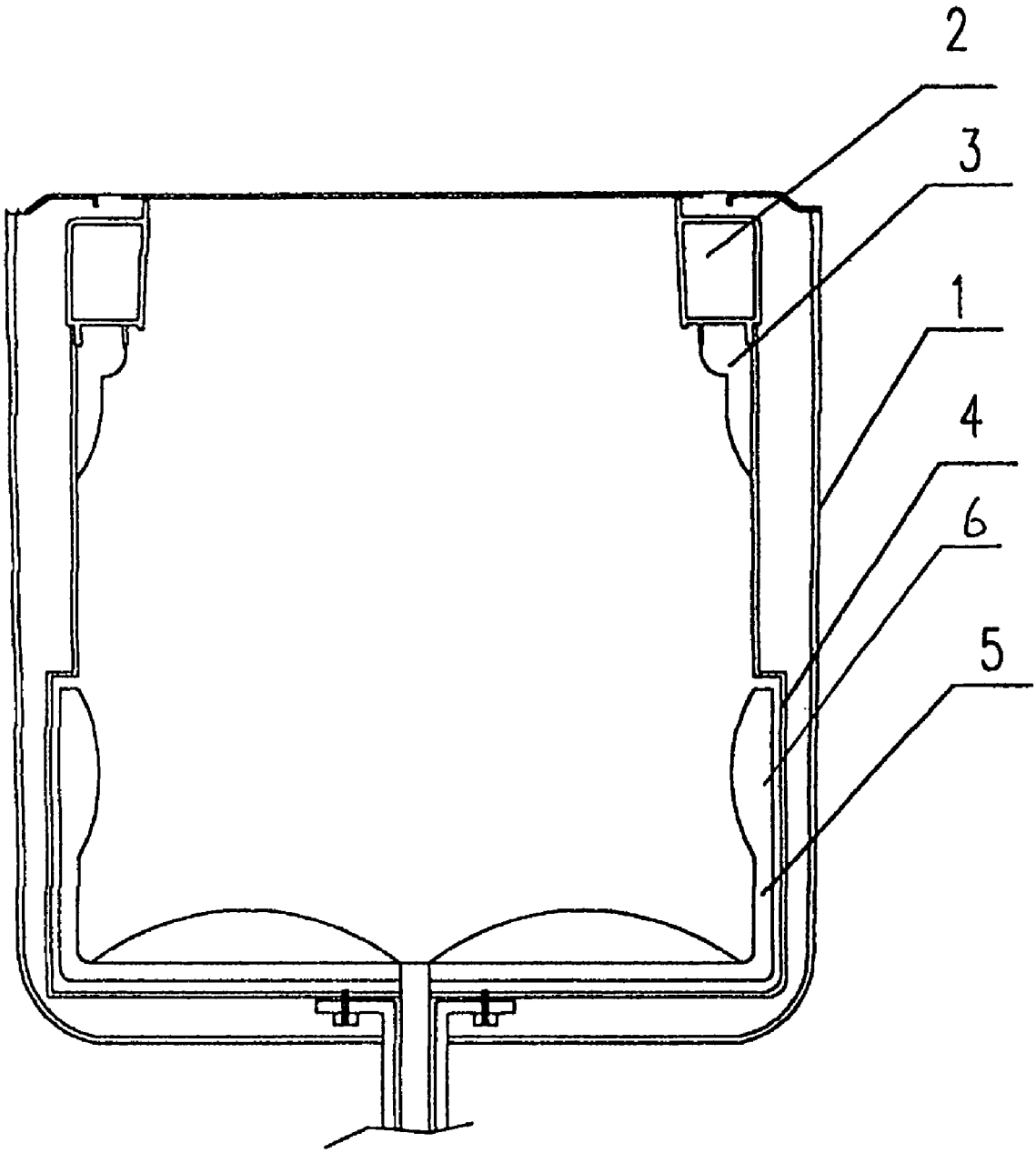
FIG. 10 shows an agitator and an inner basket in accordance with still another embodiment of the present invention.

Referring to FIGS. 8-10, an inner basket 4 in accordance with the present invention is shown, respectively. As shown in FIGS. 8 and 9, the inner basket 4 is provided with at least one inward protrusion in the radial direction on its sidewall, and it is provided with a balancing ring on the sidewall at its upper opening end. As shown in FIG. 10, a step is formed on the sidewall of the inner basket 4 to cause the inner basket to have two cylindrical sections with different diameters. Similarly, shapes of these protrusions can be different and irregular. The arrangements of protrusions promote enhancing the water to be agitated and increasing the impact force of the water stream. A step is formed circumferentially on the inner sidewall of the inner basket. The arrangement of the step facilitates the agitator 5 with a specific shape to be installed in the inner basket 4.

Although embodiments of the invention have been described in detail hereinabove, structures of the transmission mechanism of the invention, the washing machine, the inner basket and the agitator associated with it are not limited as those described above. All the improvements and modifications based on the above-described embodiments of the invention should be considered within the principle and scope of the present invention. The scope of the present invention is defined in the appended claims.

The invention claimed is:

1. A transmission mechanism suitable to be used in a washing machine for creating dual-direction driving comprising:

a drive power input end and two drive power output ends, wherein one of said drive power output ends is connected to an agitator shaft to cause said agitator shaft to rotate in a direction, while the other of said drive power output to ends is connected to a hollow inner basket shaft to cause said hollow inner basket to rotate in another direction;

a gearbox adapted to transform a drive power input into two drive power outputs, said gearbox including:

an upper shaft hole disposed in an upper end wall of said gearbox; said hollow inner-basket shaft extending through said upper shaft hole and being rotatable within said gearbox, a lower end of said hollow inner basket shaft locating in said gearbox; said agitator shaft being concentrically disposed inside said hollow inner basket shaft and being rotatable therein, a lower end of said agitator shaft extending beyond said lower end of said hollow inner basket shaft;

a lower shaft hole disposed in a lower end wall of said gearbox;

a main drive shaft disposed inside said gearbox and rotatable therein; an upper end of said main drive shaft locating in said gearbox and its lower end extending downwards and outwards through said lower shaft hole;

two pairs of gear shafts disposed in gear shaft holes arranged in said upper end wall and said lower end wall of said gearbox, respectively, and two pairs of gear parts provided on said two pairs of gear shafts, respectively, and meshing with each other;

wherein a first one of said two pairs of gear parts meshes with an outer gear disposed at said upper end of said main drive shaft and an outer gear disposed at lower end of said agitator shaft, respectively, and a second one of said two pairs of gear parts meshes with an outer gear disposed at said lower end of said hollow inner basket shaft.

2. The transmission mechanism according to claim 1, wherein said two pairs of gear shafts are symmetrically disposed in the radial direction with respect to a longitudinal axis of said gearbox, said first pair of gear parts being disposed on a first one of said two pairs of gear shafts, respectively, and having three gears per gear part, and said second pair of gear parts being disposed on a second one of said two pairs of gear shafts, respectively, and having two gears per gear part.

3. The transmission mechanism according to claim 1 or 2, wherein said outer gear disposed at said upper end of said main drive shaft meshes with a first corresponding gear of each of said first pair of gear parts, said outer gear disposed at said lower end of said hollow inner basket shaft meshing with a second corresponding gear of each of said second pair of gear parts, said outer gear disposed at said lower end of said agitator shaft meshing with a second corresponding gear of each of said first pair of gear parts, and a third corresponding gear of each of said first pair of gear parts meshing with a first corresponding gear of each of said second pair of gear parts; and said lower end of said main drive shaft being connected to a drive power source.

4. The transmission mechanism according to claim 3, wherein at least two of said gears of each of said first pair of gear parts are the same in size and shape.

5. The transmission mechanism according to claim 1, wherein said hollow inner basket shaft and said agitator shaft rotate in opposite directions with respect to each other.

6. A washing machine for creating dual-direction washing comprising:

an outer basket;

an inner basket rotatably disposed within said outer basket;

a hollow inner basket shaft;

an agitator shaft concentrically disposed inside said hollow inner basket shaft and rotatable therein;

a transmission mechanism adapted to drive two drive power output ends from a drive power input end transformed by a gearbox, said two drive power output ends being, connected to said agitator shaft and said hollow inner basket shaft, respectively;

wherein said gearbox includes:

an upper shaft hole disposed in an upper end wall of said gearbox; said hollow inner basket shaft extending through said upper shaft hole and being rotatable within said gearbox; said agitator shaft being concentrically disposed inside said hollow inner basket shaft and being rotatable therein, said hollow inner basket shaft and said agitator shaft being arranged to rotate in opposite directions with respect to each other;

a main drive shaft disposed inside said gearbox and rotatable therein, a lower end of said main drive shaft extending downwards and outwards through a lower shaft hole disposed in a lower end wall of said gearbox;

two pairs of gear shafts disposed in gear shaft holes arranged in said upper end wall and said lower end wall of said gearbox, respectively, and two pairs of gear parts provided on said two pairs of gear shafts respectively and meshing with each other;

wherein a first one of said two pairs of gear parts meshes with an outer gear disposed at an upper end of said main drive shaft and an outer gear disposed at a lower end of said agitator shaft, respectively, and a second one of said two pairs of gear parts meshes with an outer gear disposed at a lower end of said hollow inner basket shaft.

7. The washing machine according to claim 6, wherein said two pairs of gear shafts are symmetrically disposed in the radial direction with respect to a longitudinal axis of said gearbox, said first pair of gear parts being disposed on a first one of said two pairs of gear shafts, respectively, and having three gears per gear part, and said second pair of gear parts being disposed on a second one of said two pairs of gear shafts, respectively, and having two gears per gear part.

8. The washing machine according to claim 6 or 7, wherein said outer gear disposed at said upper end of said main drive shaft meshes with a first corresponding gear of each of said first pair of gear parts, said outer gear disposed at said lower end of said hollow inner basket shaft meshing with a second corresponding gear of each of said second pair of gear parts, said outer gear disposed at said lower end of said agitator shaft meshing with a second corresponding gear of each of said first pair of gear parts, and a third corresponding gear of each of said first pair of gear parts meshing with a first corresponding gear of each of said second pair of gear parts and said lower end of said main drive shaft being connected to a drive power source.

9. The washing machine according to claim 8, wherein at least two of said gears of each of said first pair of gear parts are the same in size and shape.

10. The washing machine according to claim 6, wherein said hollow inner basket shaft and said agitator shaft rotate in opposite directions with respect to each other.

11. The washing machine according to claim 6, wherein in said transmission mechanism, said lower end of said main drive shaft is connected to a drive power source; and said agitator being connected to an upper end of said agitator shaft and said inner basket being connected to an upper end of said inner basket shaft, respectively, to be rotated in opposite directions to each other.

12. The washing machine according to claim 6, wherein said agitator is a disk-shaped member, and at least one upward protrusion is formed on an upper surface of said disk-shaped member.

13. The washing machine according to claim 6, wherein said agitator is a barrel-shaped member, and at least one upward protrusion is formed on an inner bottom surface of said agitator.

14. The washing machine according to claim 6, wherein said agitator is a barrel-shaped member, and at least one inward protrusion in a radial direction is formed on an inner side wall of said agitator.

15. The washing machine according to any one of claims 12-14, wherein said protrusions of said agitator are irregular in shape.

16. The washing machine according to claim 6, wherein at least one inward protrusion in a radial direction is formed on an inner side wall of said inner basket.

17. The washing machine according to claim 16, wherein said protrusion is irregular in shape.

18. A washing method for creating a dual-direction washing comprising:

a) causing an electrical motor to drive a main drive shaft to rotate in a direction during washing;

b) causing an agitator to rotate in a first direction, and simultaneously causing an inner basket to rotate in a second reverse direction via a transmission mechanism; said transmission mechanism adapted to transform a drive power input into two drive-power outputs; including, in a gearbox:

rotating a first one of two pairs of gear parts disposed respectively on a first one of two pairs of gear shafts via an outer gear disposed at an upper end of said main drive shaft, to cause a gear disposed at a lower end of an agitator shaft to rotate in a direction; and simultaneously rotating a second one of said two pairs of gear parts disposed respectively on a second one of said two pairs of gear shafts and meshed with said first pair of gear parts, to cause a gear disposed at a lower end of a hollow inner basket shaft to rotate in a reverse direction, thereby causing said agitator and said inner basket to rotate in opposite directions;

c) causing said electrical motor to rotate in a reverse direction, to drive said main drive shaft to rotate in another direction;

d) causing said agitator to rotate in said second reverse direction, and simultaneously causing said inner basket in said first direction via said transmission mechanism; and e) repeating, at least some of steps a)-d) to complete a washing or rinsing process.

19. A washing method for creating a dual-direction washing comprising:

a) causing an electrical motor to drive a main drive shaft to rotate in a direction during washing;

b) causing an agitator to rotate in a first direction, and simultaneously causing an inner basket to rotate in a second reverse direction via a transmission mechanism; said transmission mechanism adapted to transform a drive power input into two drive-power outputs; including, in a gearbox:

rotating a first one of two pairs of gear parts disposed respectively on a first one of two pairs of gear shafts via an outer gear disposed at an upper end of said main drive shaft, to cause a gear disposed at a lower end of an agitator shaft to rotate in a direction; and simultaneously rotating a second one of said two pairs of gear parts disposed respectively on a second one of said two pairs of gear shafts and meshed with said first pair of gear parts, to cause a gear disposed at a lower end of a hollow inner basket shaft to rotate in a reverse direction, thereby causing said agitator and said inner basket to rotate in opposite directions;

wherein the gearbox includes:

an upper shaft hole disposed in an upper end wall of said gearbox; said hollow inner-basket shaft extending through said upper shaft hole and being rotatable within said gearbox, a lower end of said hollow inner basket shaft locating in said gearbox; said agitator shaft being concentrically disposed inside said hollow inner basket shaft and being rotatable therein, a lower end of said agitator shaft extending beyond said lower end of said hollow inner basket shaft;

a lower shaft hole disposed in a lower end wall of said gearbox;

a main drive shaft disposed inside said gearbox and rotatable therein; an upper end of said main drive shaft locating in said gearbox and its lower end extending downwards and outwards through said lower shaft hole;

said two pairs of gear shafts disposed in gear shaft holes arranged in said upper end wall and said lower end wall of said gearbox, respectively, and said two pairs of gear parts provided on said two pairs of gear shafts, respectively, and meshing with each other;

wherein the first one of said two pairs of gear parts meshes with the outer gear disposed at said upper end of said main drive shaft and the gear disposed at lower end of said agitator shaft, respectively, and the second one of said two pairs of gear parts meshes with the gear disposed at said lower end of said hollow inner basket shaft;

c) causing said electrical motor to rotate in a reverse direction, to drive said main drive shaft to rotate in another direction;

d) causing said agitator to rotate in said second reverse direction, and simultaneously causing said inner basket in said first direction via said transmission mechanism; and e) repeating, at least some of steps a)-d) to complete a washing or rinsing process.

20. The washing method according to claim 18 or 19, wherein:

said gear disposed at said upper end of said main drive shaft is caused to drive said agitator to rotate in a direction same as that of said main drive shaft via said first pair of gear parts and said outer gear disposed at said lower end of said agitator shaft;

at the same time, said gear disposed at said upper end of said main drive shaft is caused to drive said inner basket to rotate in a direction opposed to that of said main drive shaft via said first pair of gear parts, said second pair of gear parts and said gear disposed at said lower end of said hollow inner basket shaft;

said electrical motor is caused to rotate in a reverse direction, to drive said main drive shaft to rotate in another direction, and above procedures are repeated to make said inner basket and said agitator rotate in inverse directions; and at least some of said steps are repeated to complete said washing or rinsing process.

* * * * *